US009968818B1

(12) United States Patent
Vargas

(10) Patent No.: US 9,968,818 B1
(45) Date of Patent: May 15, 2018

(54) VEHICLE DRIVER EXERCISING SYSTEM

(71) Applicant: Jose Vargas, Bronx, NY (US)

(72) Inventor: Jose Vargas, Bronx, NY (US)

( * ) Notice: Subject to any disclaimer, the term of this patent is extended or adjusted under 35 U.S.C. 154(b) by 0 days. days.

(21) Appl. No.: 15/392,318

(22) Filed: Dec. 28, 2016

(51) Int. Cl.

| | |
|---|---|
| ***A63B 21/04*** | (2006.01) |
| ***A63B 23/16*** | (2006.01) |
| ***A63B 23/10*** | (2006.01) |
| ***A63B 23/02*** | (2006.01) |
| ***A63B 21/00*** | (2006.01) |

(52) U.S. Cl.
CPC ..... *A63B 21/0407* (2013.01); *A63B 21/4034* (2015.10); *A63B 21/4035* (2015.10); *A63B 21/4039* (2015.10); *A63B 21/4045* (2015.10); *A63B 23/0233* (2013.01); *A63B 23/10* (2013.01); *A63B 23/16* (2013.01)

(58) Field of Classification Search
CPC ..... A63B 21/4034; A63B 21/4035; A63B 21/4039; A63B 21/4045; A63B 23/0233; A63B 23/10; A63B 23/16; B62D 1/06; B62D 1/11
See application file for complete search history.

(56) References Cited

U.S. PATENT DOCUMENTS 4,013,287 A 3/1977 Dickman
4,759,543 A 7/1988 Feldman
5,445,582 A * 8/1995 Brown ..... A63B 23/16 482/124
5,681,243 A * 10/1997 Criss ..... A63B 21/028 482/49
D403,035 S * 12/1998 MacPherson ..... D21/684
6,086,518 A * 7/2000 MacCready, Jr. ..... A61B 5/225 482/44
6,500,103 B2 12/2002 Porter
6,565,485 B1 * 5/2003 Kinsella ..... A45B 3/00 482/148
7,699,762 B2 4/2010 Turnbull et al.
2003/0074766 A1 * 4/2003 Tillim ..... A61B 17/2909 16/430
2004/0254049 A1 12/2004 Martien
2008/0103033 A1 5/2008 Agarwal
2009/0318269 A1 * 12/2009 D'Addario ..... A63B 21/023 482/47
2013/0090219 A1 * 4/2013 Collins ..... A63B 23/1209 482/139
2013/0143719 A1 * 6/2013 Selek ..... A63B 23/16 482/49
2015/0190675 A1 * 7/2015 Silagy ..... A63B 23/16 482/47
2015/0238800 A1 8/2015 Henry

* cited by examiner

*Primary Examiner* — Joshua Lee

(57) ABSTRACT

A vehicle driver exercising system includes a pair of hand exercising members each removably engaged with a steering wheel. The hand exercising members each include a clip having an inner surface and an outer surface. The clip receives the steering wheel and a base is attached to the outer surface. A housing is slidably mounted to an upper surface of the base and has an outer flange is movable between an extended position extended upwardly from and spaced away from the base or a collapsed position abutting the base. A biasing member is positioned in the base and biases the housing toward the extended position.

11 Claims, 4 Drawing Sheets

VEHICLE DRIVER EXERCISING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to exercising devices and more particularly pertains to a new exercising device for providing exercising movements for a person driving a vehicle.

BRIEF SUMMARY OF THE INVENTION

An embodiment of the disclosure meets the needs presented above by generally comprising a pair of hand exercising members each removably engaged with a steering wheel. The hand exercising members each include a clip having an inner surface and an outer surface. The clip receives the steering wheel and a base is attached to the outer surface. A housing is slidably mounted to an upper surface of the base and has an outer flange is movable between an extended position extended upwardly from and spaced away from the base or a collapsed position abutting the base. A biasing member is positioned in the base and biases the housing toward the extended position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
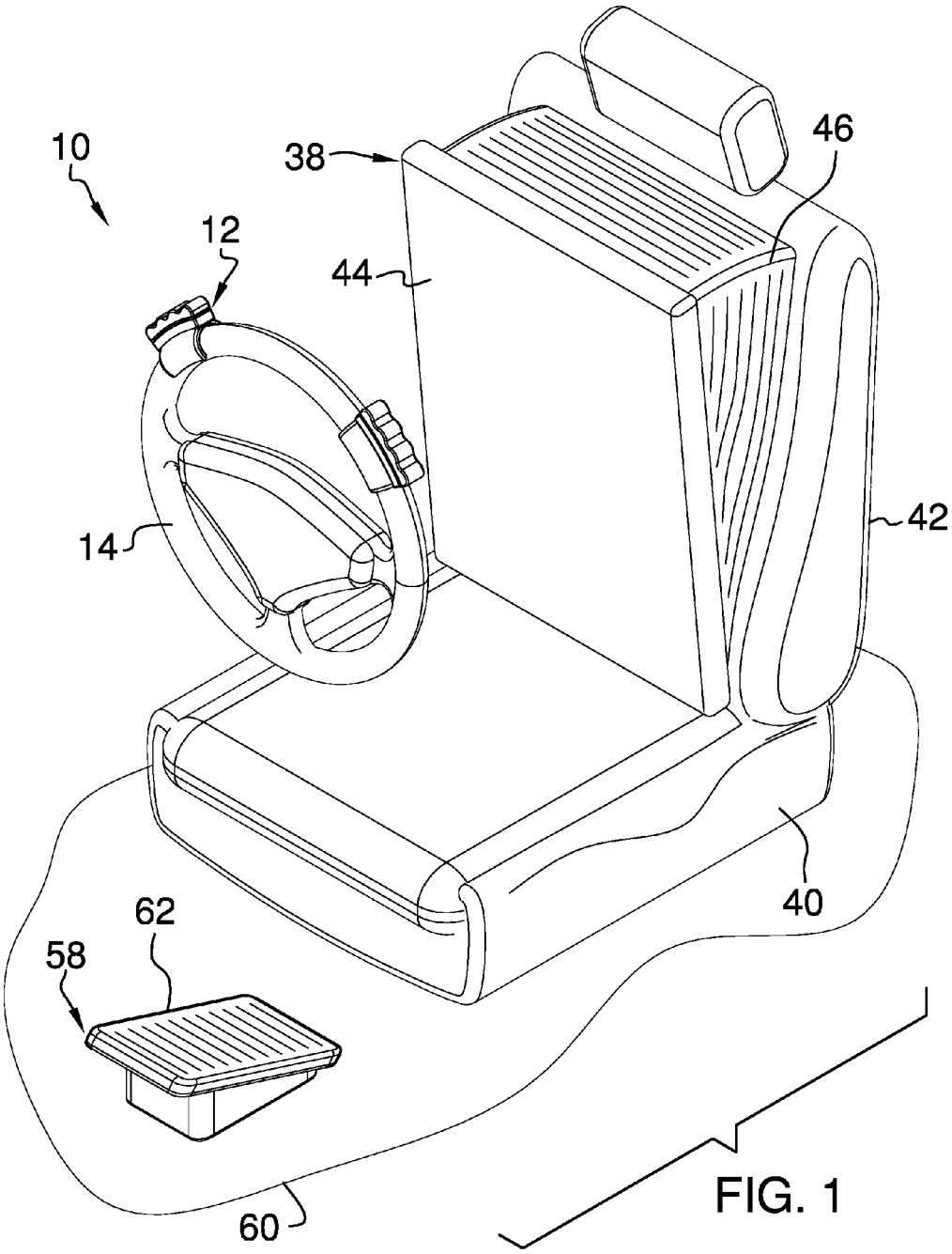
FIG. 1 is a front perspective view of a vehicle driver exercising system according to an embodiment of the disclosure.
Figure 2:
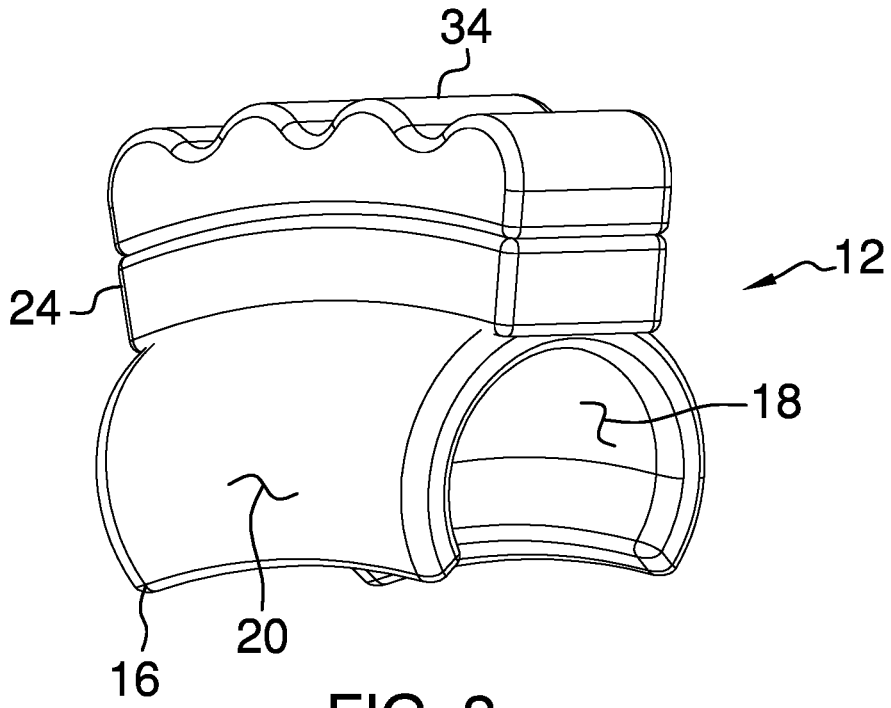
FIG. 2 is a perspective view of a hand exercising member of an embodiment of the disclosure.

With reference now to the drawings, and in particular to FIGS. 1 through 6 thereof, a new exercising device embodying the principles and concepts of an embodiment of the disclosure and generally designated by the reference numeral 10 will be described.

Figure 3:
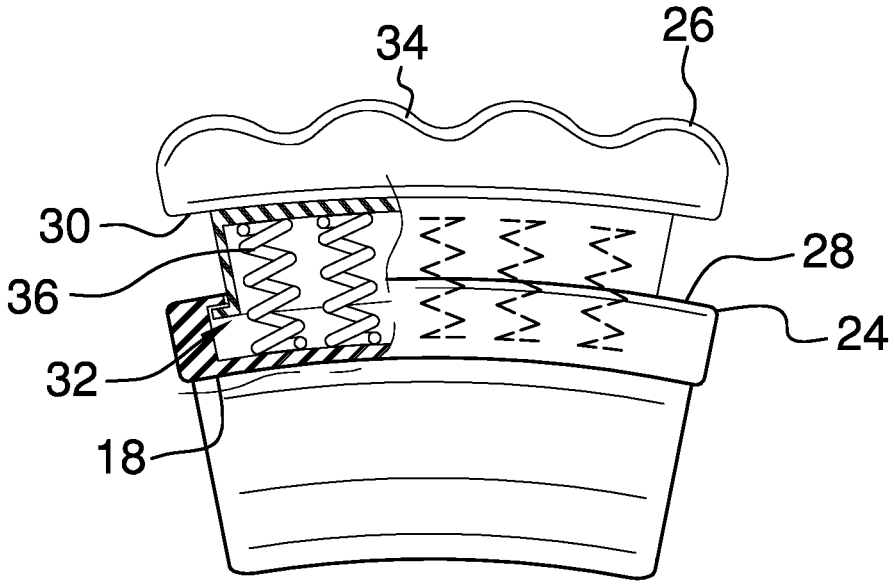
FIG. 3 is a front broken view of the hand exercising member of an embodiment of the disclosure.
Figure 4:
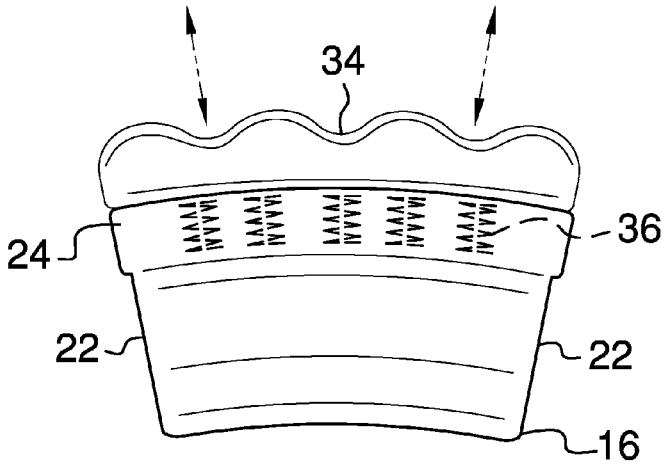
FIG. 4 is a rear view of the hand exercising member of an embodiment of the disclosure.
Figure 5:
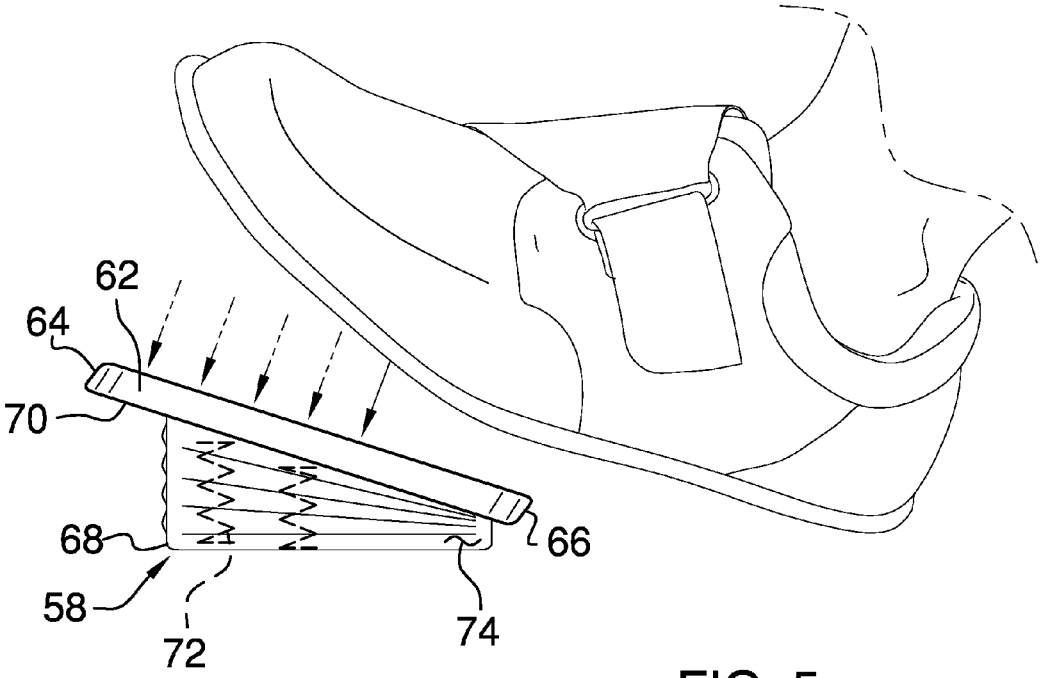
FIG. 5 is a side view of a foot exercising member of an embodiment of the disclosure.
Figure 6:
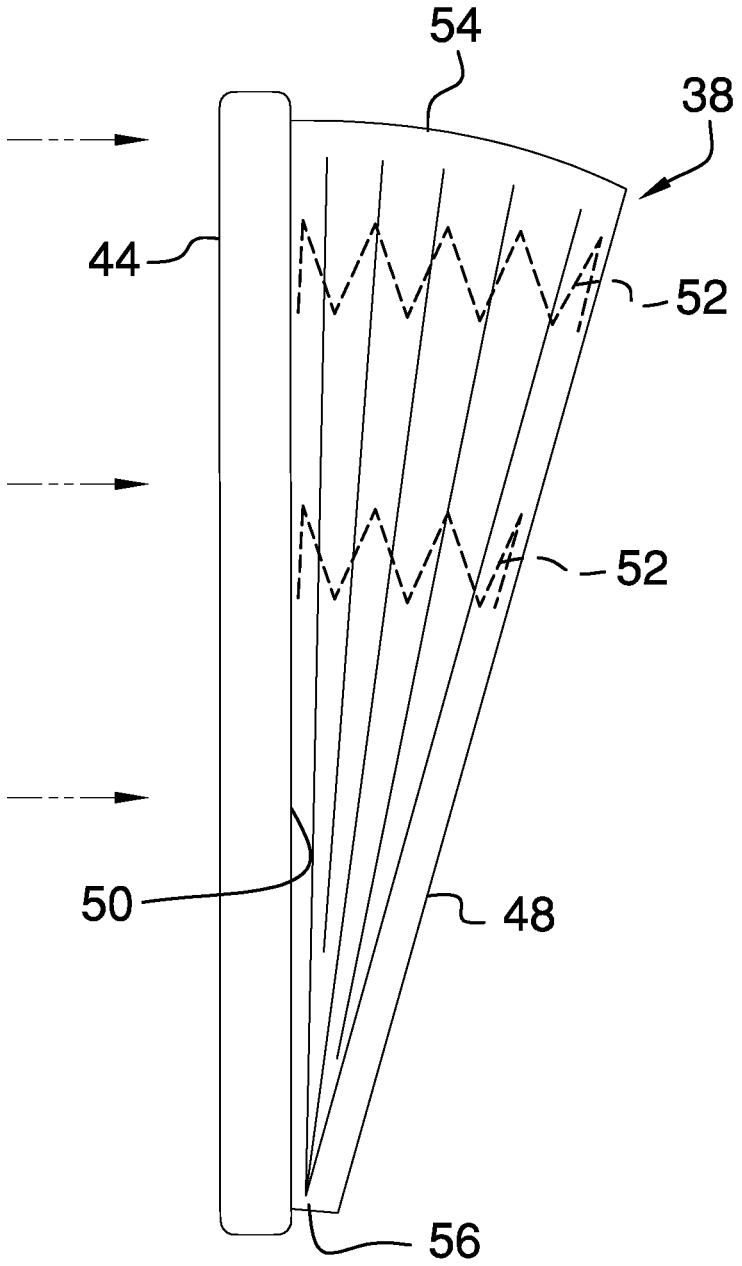
FIG. 6 is a side view of a back exercising member of an embodiment of the disclosure.

As best illustrated in FIGS. 1 through 6, the vehicle driver exercising system 10 generally comprises a pair of hand exercising members 12 wherein each is removably engaged with a steering wheel 14. The steering wheel 14 may be any conventional steering wheel found within a vehicle. Each of the hand exercising members 12 includes a clip 16 having an inner surface 18 and an outer surface 20. The clip 16 receives the steering wheel 14 such that the steering wheel 14 abuts the inner surface 18 and the clip 16 at least partially bounds an exterior surface of the steering wheel 14. The clip 16 has a semi-tubular shape and the clip 16 is comprised of a resiliently flexible material such as a plastic or an elastomeric material. A non-slip material may be positioned on the inner surface 18 of the clip 16 to prevent its rotation relative to the steering wheel 14. As can be seen in FIG. 4, the clip 16 may be arcuate between its outer ends 22 to contour to the shape of circular steering wheel.

A base 24 is attached to the outer surface 20 of the clip 16. A housing 26 is slidably mounted to an upper surface 28 of the base 24 and has an outer flange 30 that is movable between an extended position extended upwardly from and spaced away from the base 24 or a collapsed position abutting the base 24. Interior shoulders 32 on the base 24 and housing 26 engage each other to prevent the housing 26 from being removed from base 24. An upper side 34 of the housing 26 is formed into a plurality of finger grips. A biasing member 36 is positioned in the base 24 and biases the housing 26 toward the extended position. The biasing member 36 may comprise a plurality of compression springs extending into the housing 26 as can be seen in FIG. 3.

A back exercising member 38 is removably positioned on a car seat 40 and abuts a back rest 42 of the car seat 40. The back exercising member 38 includes a front panel 44 and a rear panel 46 each being vertically oriented and being attached to each other. The rear panel 46 comprises a collapsible body and has a distal side 48 and a proximal side 50 with respect to the front panel 44. The front panel 44 is substantially rigid in that its shape does not warp or bend, though it may be padded or be shaped to the contours of a person's back for the comfort of the user of the system 10. The distal side 48 abuts the backrest 42 and an urging member 52 is positioned within the rear panel 46 and urges the front panel 44 away from the distal side 48. The urging member 52 may comprise one or more compression springs. The rear panel 46 has a top edge 54 and a bottom edge 56. A first length is defined from the distal edge 48 to the front panel 44 along the top edge 54 and a second length is defined from the distal edge 48 to the front panel 44 along the bottom edge 56. The first length is greater than the second length. This allows the bottom edge 56 to act as a pivot for the rear panel 46, which may comprise an accordion type housing, so that the user of the back exercising member pivots at their waist to force the top edge 54 to collapse.

A foot exercising member 58 is positionable on a floor 60 of a vehicle and includes a foot panel 62 having a front edge 64 and a rear edge 66. A lifting member 68 is attached to a bottom side 70 of the foot panel 62 and lifts the foot panel 62 upwardly away from the floor 60. The lifting member 68 lifts the front edge 64 higher from the floor 60 than the rear edge 66 such that the food panel 62 is angled downwardly from the front edge 64 to the rear edge 66. The rear edge 66 faces the car seat 40. The lifting member 68 may include one or more springs 72 within an accordion housing 74.

In use, the hand 12, foot 58 and back 38 exercising members are positioned within a vehicle as described above and as shown in the Figures to provide a driver with the ability to move and exercise portions of their body during long drives. This will prevent driving fatigue as well as retain the body in better fitness with less soreness from driving.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercising system for facilitating body motion while driving, said system comprising:

a pair of hand exercising members each being removably engaged with a steering wheel, each of said hand exercising members including:

a clip having an inner surface and an outer surface, said clip receiving said steering wheel;

a base being attached to said outer surface;

a housing being slidably mounted to an upper surface of said base, said housing having an outer flange being movable between an extended position extended upwardly from and spaced away from said base or a collapsed position abutting said base; and a biasing member being positioned in said base and biasing said housing toward said extended position.

2. The exercising system according to claim 1, wherein said steering wheel abuts said inner surface and said clip at least partially bounds an exterior surface of said steering wheel.

3. The exercising system according to claim 1, wherein said clip is comprised of a resiliently flexible material.

4. The exercising system according to claim 1, wherein an upper side of said housing forms a plurality of finger grips.

5. The exercising system according to claim 1, further including a back exercising member being removably positioned on a car seat and abutting a back rest of said car seat, said back exercising member including a front panel and a rear panel each being vertically oriented and being attached to each other, said rear panel comprising a collapsible body and having a distal side and a proximal side with respect to said front panel, said distal side abutting said backrest, an urging member being positioned within said rear panel and urging said front panel away from said distal side.

6. The exercising system according to claim 5, wherein said rear panel has a top edge and a bottom edge, a first length being defined from said distal edge to said front panel along said top edge, a second length being defined from said distal edge to said front panel along said bottom edge, said first length being greater than said second length.

7. The exercising system according to claim 1, further including a foot exercising member being positionable on a floor of a vehicle, said foot exercising member including a foot panel having a front edge and a rear edge, a lifting member being attached to a bottom side of said foot panel and lifting said foot panel upwardly away from said floor.

8. The exercising system according to claim 7, wherein said lifting member lifts said front edge higher from said floor than said rear edge such that said food panel is angled downwardly from said front edge to said rear edge.

9. The exercising system according to claim 5, further including a foot exercising member being positionable on a floor of a vehicle, said foot exercising member including a foot panel having a front edge and a rear edge, a lifting member being attached to a bottom side of said foot panel and lifting said foot panel upwardly away from said floor.

10. The exercising system according to claim 9, wherein said lifting member lifts said front edge higher from said floor than said rear edge such that said food panel is angled downwardly from said front edge to said rear edge, said rear edge facing said car seat.

11. An exercising system for facilitating body motion while driving, said system comprising:

a pair of hand exercising members each being removably engaged with a steering wheel, each of said hand exercising members including:

a clip having an inner surface and an outer surface, said clip receiving said steering wheel such that the steering wheel abuts said inner surface and said clip at least partially bounds an exterior surface of said steering wheel, said clip having a semi-tubular shape, said clip being comprised of a resiliently flexible material;

a base being attached to said outer surface;

a housing being slidably mounted to an upper surface of said base, said housing having an outer flange being movable between an extended position extended upwardly from and spaced away from said base or a collapsed position abutting said base, an upper side of said housing forming a plurality of finger grips;

a biasing member being positioned in said base and biasing said housing toward said extended position;

a back exercising member being removably positioned on a car seat and abutting a back rest of said car seat, said back exercising member including a front panel and a rear panel each being vertically oriented and being attached to each other, said rear panel comprising a collapsible body and having a distal side and a proximal side with respect to said front panel, said distal side abutting said backrest, an urging member being positioned within said rear panel and urging said front panel away from said distal side, said rear panel having a top edge and a bottom edge, a first length being defined from said distal edge to said front panel along said top edge, a second length being defined from said distal edge to said front panel along said bottom edge, said first length being greater than said second length; and a foot exercising member being positionable on a floor of a vehicle, said foot exercising member including a foot panel having a front edge and a rear edge, a lifting member being attached to a bottom side of said foot panel and lifting said foot panel upwardly away from said floor, said lifting member lifting said front edge higher from said floor than said rear edge such that said food panel is angled downwardly from said front edge to said rear edge, said rear edge facing said car seat.

* * * * *